United States Patent [19]

Helinski

[11] 4,438,419

[45] Mar. 20, 1984

[54] SERIAL RING ACTUATOR

[75] Inventor: Edward F. Helinski, Johnson City, N.Y.

[73] Assignee: International Business Machines Corporation, Armonk, N.Y.

[21] Appl. No.: 402,486

[22] Filed: Jul. 28, 1982

[51] Int. Cl.[3] ..... H01F 7/08

[52] U.S. Cl. ..... 335/261; 335/264; 335/279

[58] Field of Search ..... 335/255, 258, 259, 261, 335/262, 264, 265, 279

[56] References Cited

U.S. PATENT DOCUMENTS

| | | | |
|---|---|---|---|
| 3,946,851 | 3/1976 | Cestrieres et al. | 335/229 X |
| 4,046,244 | 9/1977 | Velazquez | 335/229 X |
| 4,200,401 | 4/1980 | Roy et al. | 335/261 X |
| 4,339,109 | 7/1982 | Kawata et al. | 336/261 X |

*Primary Examiner*—George Harris
*Attorney, Agent, or Firm*—John S. Gasper

[57] ABSTRACT

A linear solenoid device comprises a cylindrical armature or plunger freely movable within the central opening of a stator which comprises a cylindrical coil wound between a pair of annular end pole members and surrounding one or more intermediate annular pole members. The intermediate pole members are axially spaced and aligned with the end pole members by a bobbin which preferably is injection molded. The armature has plural axially spaced and aligned annular pole members concentrically arranged within the central opening of the single cylindrical coil. The magnetic stator and armature poles take the form of rings which are dimensioned and arranged so that the magnetic flux generated by the coil passes in a series path alternately from the stator to the armature rings and then through a cylindrical magnetic casing which forms a magnetic flux path between the end pole members. The armature includes a support body of non-magnetizable material which may be plastic and can be injection molded. The support body has annular bearing surfaces formed between the armature rings for maintaining annular air gaps between stator pole member and armature rings and for positioning the armature within the central opening.

9 Claims, 6 Drawing Figures

SERIAL RING ACTUATOR

FIELD OF THE INVENTION

This invention relates to solenoid devices and particularly to a solenoid device useful as an actuator for driving an impact or print element of a printer apparatus.

BACKGROUND OF THE INVENTION

Actuators for printers must have the capability of consistent operation at high speeds and high repetition rates at high impact force levels for long periods. The problem with known solenoid devices which limits achieving optimum operating results is the high mass of the armature or moving structure. A further problem is that the stator structure using coil and magnetic elements have not been able to efficiently provide the amount of energy to obtain the required velocity and impact force. Attempts to increase magnetic efficiency have usually produced structures which are increasingly complex and have an increased mass thereby reducing the force to mass ratio.

U.S. Pat. No. 3,838,370, issued Sept. 24, 1974 to T. Ueno et al discloses a solenoid magnet having an annular coil between two annular magnetizable stator poles mounted inside a magnetic casing. An armature assembly has two annular magnetizable bodies with the same spacing as the stator poles so as to be simultaneously receivable within the central openings of the coil and stator poles. The armature bodies are connected internally by a rod which uses magnetic material for providing a magnetic flux path through the armature core bodies and the connecting rod.

U.K. Patent Application GB2004504A of Exxon Research and Engineering Co. published Apr. 4, 1979 discloses a print hammer comprising a stator consisting of a winding within a stationary magnetic structure comprising end pole pieces and a cylindrical casing which generates a flux for imparting an impact force to a solid cylindrical magnetic core connected to a non-magnetic impact member.

U.S Pat. No. 4,306,206, issued Dec. 15, 1981 to J. L. Meyers discloses a solenoid device where a cylindrical coil is located between stator poles mounted within a magnetic casing. A cylindrical armature has a magnetic central core and a magnetic peripheral core ring. The core ring and the core define a flux carrying path between a pair of axially spaced cylindrical armature pole surfaces. The armature further has a pair of radially polarized axially spaced annular permanent magnets adjacent the armature pole surfaces.

SUMMARY OF THE INVENTION

The present invention is characterized by a stator and armature both having a plurality of magnetizable annular or ring pole members axially separated and concentrically arranged within the central opening of a single cylindrical coil. The plurality of stator pole members includes at least one intermediate pole member axially separated by high reluctance gaps from a pair of end pole members the latter being magnetically connected to a magnetic casing for forming a flux path. The magnetic stator and armature rings are dimensioned and arranged so that the magnetic flux generated by the coil passes in a series path alternately from the stator to the armature rings and then through the casing. The armature includes a support body of non-magnetizable material which can be lightweight compared to magnetic materials and preferably is plastic and can be injection molded. By using magnetic ring pole members, the magnetic connection between the magnetic armature bodies has been eliminated thereby making it possible to greatly reduce the mass of the armature. Additionally, by using the plurality of magnetizable annular pole members or rings in the stator, including at least one intermediate magnetic ring, the magnetic efficiency is greatly improved. The series flux path formed by the stator and armature rings without a magnetic connection between the armature rings greatly increases magnetic efficiency. Impact energy and force increases can be readily realized by increasing the thickness of the stator rings without a proportional increase in the armature rings. The invention further provides for the provision of a bearing structure which is integral with the armature. Specifically, the annular bearing means are salient annular surfaces formed as integral parts between the armature rings. This structure provides a very compact design which also provides the means for obtaining a very precise annular air gap between the stator and armature rings.

The foregoing and other objects, features and advantages of the invention will be apparent from the following more particular description of a preferred embodiment of the invention, as illustrated in the accompanying drawing.

DETAILED DESCRIPTION OF THE INVENTION

Figure 2:
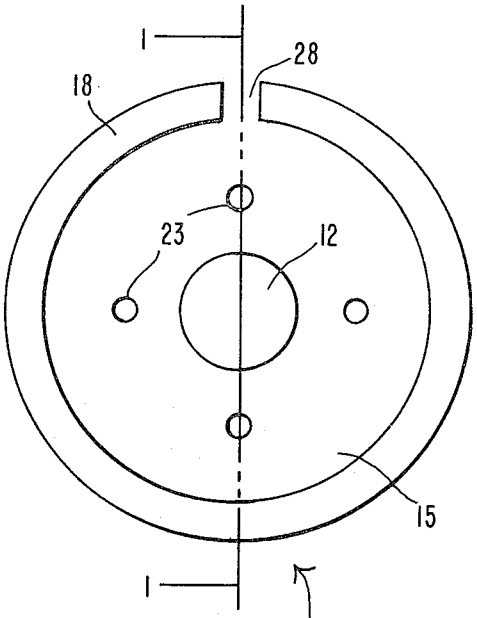
FIG. 2 is an end view of the stator portion of FIG. 1.

Referring to the drawing, the solenoid device 10 according to the invention consists of a cylindrical stator 11 having a central opening 12 and a cylindrical armature or impactor assembly 13 freely movable in central opening 12. Stator 11 has a magnetic structure consisting of annular end pieces 14, 15, annular stator rings 16, 17 and a cylindrical casing 18. End pieces 14, 15 and the stator ring 16, 17 are maintained axially spaced and aligned by a plastic bobbin 19 having integral end flanges 20 and 21 connected by a center tube 22. End pieces 14, 15 are formed with a number of openings 23 which receive plastic material of the end flanges 20, 21 for holding the end pieces in place. Stator rings 16, 17 are imbedded in the inner wall of center tube 22. End pieces 14, 15 and stator rings 16, 17 are axially spaced by spacer sections 24, 25, 26 of the center tube 22. Bobbin 19 preferably is formed by injection molding. In this way the end pieces and stator rings can be precisely aligned and axially spaced so that the axial gaps formed by spacers 24, 25, 26 can be very precisely made. A solenoid coil 27 is wound on center tube 22 in the space between flanges 20 and 21 of bobbin 18. The stator rings 16, 17 are thereby located within the central opening of and between the ends of solenoid coil 27. Cylindrical casing 18 totally encloses the bobbin structure and forms a magnetic flux path connection between the end pieces 14, 15. Casing 18 has a slot 28 to reduce eddy currents and to also provide access for leads (not shown) to coil 27. Similar eddy current reduction slots (not shown) may be provided in stator rings 16 and 17.

Figure 1:
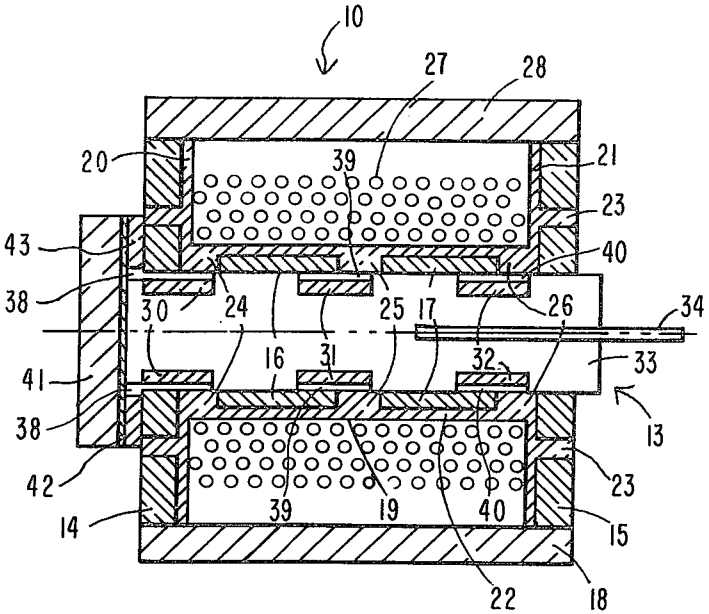
FIG. 1 is a side view in section of a solenoid actuator mechanism incorporating the features of the invention.
Figure 3:
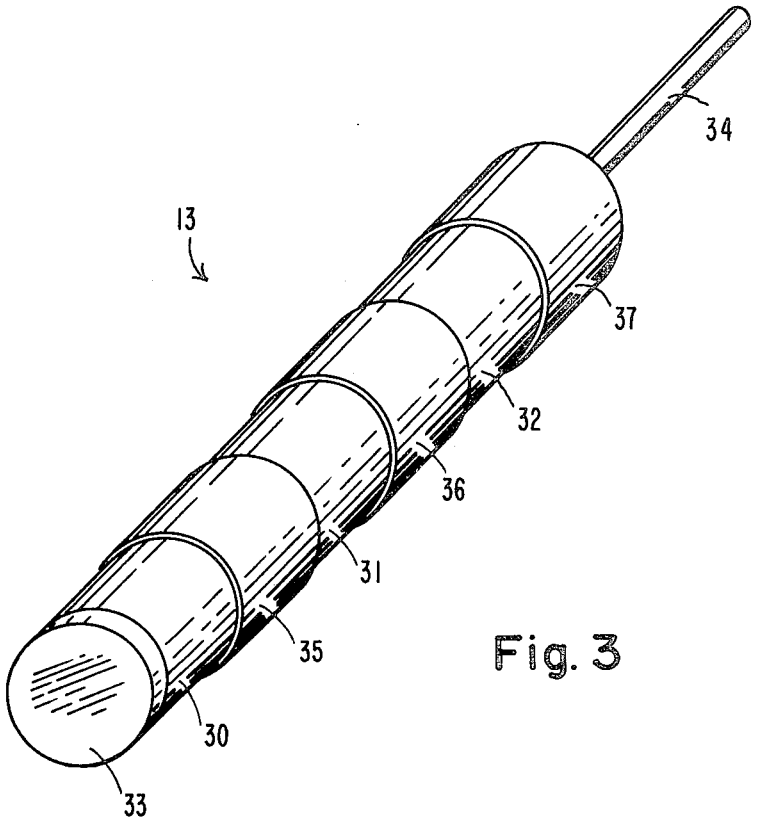
FIG. 3 is a three dimensional view of the armature portion of the actuator of FIG. 1.

Armature 13 comprises magnetic armature rings 30, 31 and 32 axially spaced and aligned by armature core 33 made from a non-magnetizable material such as plastic. The armature and stator rings can be constructed using 1008 or 1010 steel which is readily available and easy to fabricate. Parts are then plated with electrolysis nickel for rust prevention and good wear characteristics. An operating element 34, which might be a print wire or other impact element, is embedded in the center of core 33. Armature core 33 which preferably is made by injection molding plastic through and between armature rings 30, 31, 32 has annular bearing surfaces 35, 36, 37. The bearing surfaces 35, 36, 37 extend radially beyond the outer surfaces of armature rings 30, 31, 32 so as to slidably engage stator 11 within central opening 12. Annular armature/stator air gaps 38, 39 and 40 are formed by providing annular bearing surfaces 35, 36, 37 with a diameter greater than the outer diameter of annular armature rings 30, 31, 32. By injection molding the armature core 33 the dimension of the annular air gaps 38, 39, 40 between armature rings 30, 31, 32 and end pieces 14, 15 and stator rings 16, 17 can be very precisely dimensioned and maintained. Permanent magnet 41 damping member 42 and spacer ring 43 are attached to end piece 14. The permanent magnet 41 attracts armature ring 30 thereby holding armature 13 in its leftmost or starting position shown in FIG. 1.

As previously stated in accordance with this invention the annular stator and armature rings are concentrically arranged, axially spaced and dimensioned such that magnetic flux generated by energizing coil 27 flows serially through the annular stator and armature magnetic members to provide maximum thrust with maximum magnetic efficiency. This is more clearly illustrated in FIG. 4 which shows the initial or start position of armature 13. As shown there, the length a of the armature ring 30 is such that the leftmost portion overlaps end piece 14 but is short of stator ring 16 by an axial separation x. The length b of the axial gap 24 is greater than the sum of axial separation x and the width w of annular air gap 34. The same spatial and dimensional relationships apply for armature ring 31 relative to stator rings 16, 17 and for armature ring 32 relative to stator ring 17 and end piece 15. In both cases the axial gaps 25 an 26 are each greater than the sum of the axial separation x and the distance w across annular air gaps 35 and 36 respectively. This is to insure that the force providing flux is always greater than the leakage flux thereby promoting efficient operation. However making gaps 24, 25, 26 unduly large will lead to a massive structure without an accompanying increase in force production. This is also true for armature spacers 35, 36, 37. With this arrangement, the path of the magnetic flux is serial in the axial direction as shown by the meandering flux lines 46 and 47 thereby providing axial thrust with minimum flux loss.

While the dimensions a, b and x can vary to meet various design requirements, an optimum set of parameters would be where $b \lesssim 4$ x. Also the length c of the axial gaps 35 and 36 between armature rings 30, 31, 32 is preferably also equal to or greater than 4 x.

Figure 4:
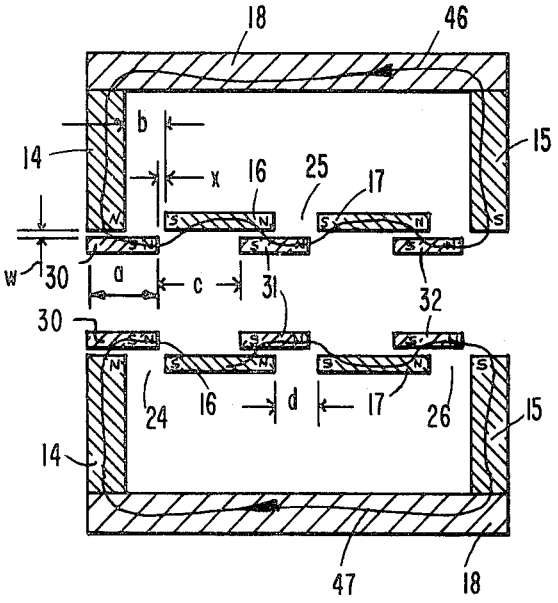
FIG. 4 is a schematic of the magnetic structure of FIG. 1 showing the armature at its initial position.
Figure 5:
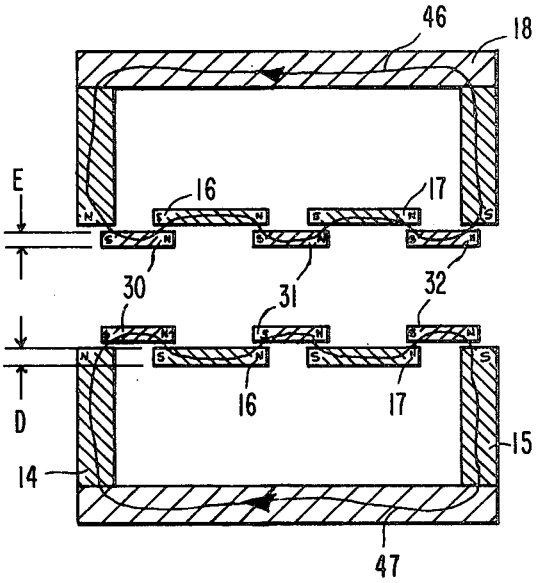
FIG. 5 is a schematic of the magnetic circuitry of FIG. 1 showing the armature in the equilibrium position.

A further feature of the invention is that the length a of armature rings 30, 31, 32 should be greater than the length d of the axial gaps separating stator rings 16, 17 from each other and from end pieces 13, 14 so that as seen in FIG. 5 there is substantial overlap of opposite end portions of armature rings 30, 31, 32 with their adjacent stator elements 14, 16, 17 and 15 when armature 13 is moved to the equilibrium position as shown in FIG. 5. The amount and degree of overlap can vary but preferably is equal to the overlap of the left most portion of armature rings 30, 31, 32 at the initial position which corresponds approximately to twice the length of the power stroke as shown in FIG. 4.

A further feature of the invention provides for the stator rings 16, 17 to have a cross sectional thickness D equal to or greater than the cross sectional thickness E (See FIG. 5) of the armature rings 30, 31, 32. This assures that the stator rings 16, 17 will not saturate before the armature rings 30, 31, 32 thereby assuring maximum energy application to the armature 13 with maximum efficiency of operation.

Figure 6:
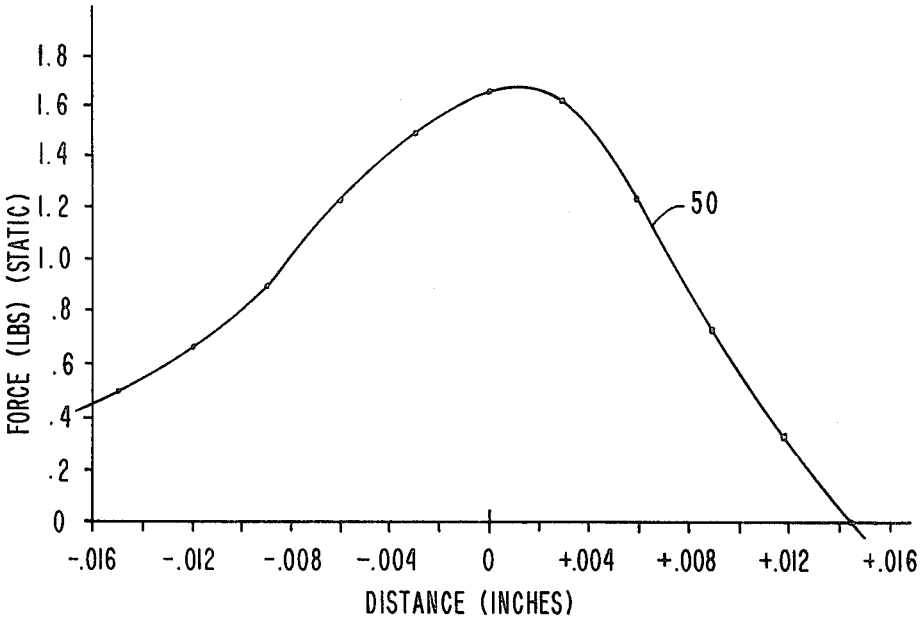
FIG. 6 is a graph showing the force vs displacement characteristic of the actuator mechanism of FIGS. 1–3.

FIG. 6 shows the force displacement characteristic of a ring actuator mechanism built in accordance with this invention. Curve 50 shows static force at various positions of displacement where the energizing current was equal to 3.2 amps peak. An armature constructed with 4 rings having a weight of 0.14 grams was utilized. Stator ring length was 0.060 inches with a gap separation of 0.020 inches. The armature ring had a length of 0.048 inches and a cross-sectional thickness of 0.015 inches. The cross-sectional thickness of the stator rings was 0.022. From FIG. 6, it will be seen that maximum static accelerating force is delivered in the rest position at 0 on curve 50. Also it will be seen that a high accelerating force to mass ratio and sufficient print energy can be achieved with a relatively short stroke length. Such performance of an actuator is highly suitable for use in impact printers of the type where wire print elements are driven to print characters in the form of dots. Greater energy can be provided to the impact element by increasing the stroke length by suitable design of the armature and stator magnetic structures. Thus it will be seen that an actuator mechanism has been provided which provides wide design latitude to achieve maximum force to mass to ratios without sacrificing efficiency and without increased complexity in the design.

While the invention has been particularly shown and described with reference to a preferred embodiment thereof, it will be understood by those skilled in the art that various changes in form and details may be made therein without departing from the spirit and scope of the invention.

I claim:

1. A linear solenoid device comprising stator means including a plurality of magnetizable annular stator pole members having aligned central openings including a pair of end stator pole members and at least one intermediate pole member axially spaced from and separated by axial gaps between said end pole members, flux generating means comprising a single cylindrical coil means between said end pole members and surrounding said intermediate pole member, said cylindrical coil means having a central opening coaxial with said central openings of said stator pole members, means including casing means forming a magnetic path between said end pole members for flux generated by said coil means when energized, and armature means freely movable axially within said central opening of said pole members and said coil means including a plurality of magnetizable annular armature pole elements disposed in axially spaced relationship, said armature pole elements being concentric with said stator pole members so as to form a plurality of axially spaced annular air gaps with said stator pole members, said armature pole elements being dimensioned and arranged to be received simultaneously in said central openings of said stator pole members, said armature pole elements having a length whereby when said armature means is at a rest position said armature pole elements each have a portion at one end in a partial overlap relationship with one of said stator pole members and an opposite end having an axial separation from the near edge of an adjacent one of said stator pole members, and an armature support body axially spacing said armature pole members, said armature support body having portions of non-magnetizable material separating said armature pole elements.

2. A linear solenoid device in accordance with claim 1 in which said intermediate pole member is mounted on said coil means within said central opening.

3. A linear solenoid device in accordance with claim 2 in which said coil means further comprises a cylindrical coil support body having a central opening and a winding surrounding said support body, and said intermediate pole member is mounted on said cylindrical coil support body in said central opening.

4. A linear solenoid device in accordance with claim 1 in which said armature support body includes annular bearing means for slidably supporting said armature within said central opening of said end and intermediate pole members of said stator means.

5. A linear solenoid device in accordance with claim 4 in which said armature support body is a plastic support body and said annular bearing means comprises salient bearing portions separating said armature pole elements, and said salient bearing means having an annular bearing surface slidably engageble with said stator pole members so as to maintain said annular air gaps.

6. A solenoid device in accordance with claim 1 in which said length of said armature pole elements is greater than said axial gaps between said intermediate and said end pole members of said stator means, said armature pole elements having opposite ends in partial overlap relationship with adjacent stator pole members when said coil means is energized.

7. A solenoid device in accordance with claim 1 in which said length of said armature pole elements is such that said axial gaps between said intermediate and end pole members of said stator means have a gap length at least four times said axial separation between said armature pole elements and said near edge of said adjacent stator pole members.

8. A solenoid device in accordance with claim 7 in which said armature pole elements are axially spaced by an amount equal to at least four times said axial separation between the end of said armature pole elements and said near edge of said stator pole members.

9. A solenoid device in accordance with claim 1 in which the cross-sectional thickness of said intermediate stator pole member is at least equal to the cross-sectional thickness of said armature pole elements.

* * * * *

UNITED STATES PATENT AND TRADEMARK OFFICE

CERTIFICATE OF CORRECTION

PATENT NO. : 4,438,419

DATED : March 20, 1984

INVENTOR(S) : E. F. Helinski

It is certified that error appears in the above—identified patent and that said Letters Patent is hereby corrected as shown below:

In Column 3, line 68, $b \leq 4x$ should read $b \geq 4x$

Signed and Sealed this

Ninth Day of April 1985

[SEAL]

*Attest:*

DONALD J. QUIGG

*Attesting Officer* *Acting Commissioner of Patents and Trademarks*